US005426437A

United States Patent [19]

Cross et al.

[11] Patent Number: 5,426,437

[45] Date of Patent: Jun. 20, 1995

[54] OPTICAL DATA DISTRIBUTION SYSTEM FOR PHASED-ARRAY ANTENNA

[75] Inventors: Michael A. Cross, Severna Park, Md.; John R. Linkowski, Alexandria, Va.

[73] Assignee: Westinghouse Electric Corporation, Pittsburg, Pa.

[21] Appl. No.: 697,369

[22] Filed: May 9, 1991

[51] Int. Cl.[6] ..... H01Q 3/22

[52] U.S. Cl. ..... 342/372; 385/49; 385/119

[58] Field of Search ..... 385/49, 119; 342/372

[56] References Cited

U.S. PATENT DOCUMENTS 4,327,963 5/1982 Khoe et al. ..... 350/96.18
4,440,470 4/1984 Khoe ..... 350/96.20
4,965,603 10/1990 Hong et al. ..... 342/372
5,046,798 9/1991 Yagiu et al. ..... 350/34
5,065,011 11/1991 Fujihara et al. ..... 250/227.24
5,087,122 2/1992 Ostrander et al. ..... 356/73.1

*Primary Examiner*—Mark Hellner

[57] ABSTRACT

An optical data distribution system, for densely packed transmitter/receiver modules, of a phased-array antenna which includes an optical source and a plurality of light bars for distributing the optical energy to the photoconductor of each respective transmitter/receiver module. Each bifurcated light bar has an entrance aperture coupled to the optical source through a star coupling and branched light distributing elements branching from the entrance aperture air gap bridging optics to direct the light from each output aperture of fiber bundles to the photodetector.

20 Claims, 9 Drawing Sheets

OPTICAL DATA DISTRIBUTION SYSTEM FOR PHASED-ARRAY ANTENNA

BACKGROUND OF THE INVENTION

1. Field of the Invention

The present invention relates to control signal distribution for T/R (transmitter/receiver) modules of a phased-array antenna, and more particularly to a control-signal distribution system for densely packaged T/R modules of a phased-array antenna.

2. Discussion of the Background

Phased-array antennas for use in smaller aircraft must of necessity be small. In order to achieve the required antenna performance with a small antenna, it is necessary to operate at a high radio frequency (e.g., X-band) and to employ a large number of radiating elements and associated T/R modules. The small antenna size and the large number of T/R modules are reflected in the packaging density. Under these conditions, it is difficult to effectively distribute control signals in such dense phased-array antennas with existing hardware. For example, hardwired signal interfaces to the modules are impractical because it is difficult to make reliable connections to a large number of T/R modules without causing excessive crosstalk between power and data conductors.

Optical data distribution technology is known to have a potential to solve these problems. For example, the optical data transmission path which carries the control-signal lends itself to being reliably connected to the input of the phased-array antennas. Although optical data distribution technology has been applied successfully to large size, low frequency, phased-array antennas (e.g., AST surveillance antennas), it has not been successfully applied to small-size, high-frequency, phased-array antennas having a large number of miniaturized T/R modules because the small-size, high-frequency antennas require high packaging density. Thus, the space available for accommodating signal distribution is extremely limited. This large number of miniaturized T/R modules typically requires closer spacing between the modules than does the large-size, low-frequency, phased-array antennas.

In dense/packed phased-array antennas, it is further required that control-signal highways which terminate within each T/R module should be efficient in terms of optical energy transfer ratio for signal delivery to the T/R module. For example, the BER (Bit Error Rate) for the control-signal at each T/R module should be better than $10^{-9}$. This in turn demands uniform optical energy distribution to each T/R module and efficient coupling of the optical energy across air gaps with low sensitivity to positional tolerances. At present, this type of optical energy distribution is not achievable in small-size, high-frequency, phased-array antennas.

SUMMARY OF THE INVENTION

One of the objects of the present invention is to overcome the aforesaid problems and provide a highly reliable, simple, and economical control signal distribution to T/R modules of a phased-array antenna.

Another object of the present invention is to provide an optical data distribution system that satisfies the constraints imposed by extremely limited physical space with a demanding signal highway specification.

Another object of the present invention is to provide an optical data distributions system that enhances air gap bridging efficiency between an optical termination and a T/R module photodetector.

A further object of the present invention is to provide an optical data distribution system that has relatively high packing efficiency and high optical coupling efficiency.

Additional objects and advantage of the present invention will be set forth in part in the description which follows, and in part will be obvious from the description or may be learned from practice of the invention. The objects and advantages of the invention may be realized and attained by means of the instrumentalities and combinations particularly pointed out in the appended claims.

To achieve the objects and in accordance with the purposes of the present invention as embodied and broadly described herein, an optical data distribution system of the present invention comprises a plurality of T/R modules, each having a photodetector at a predetermined location for receiving optical signals; a housing for supporting the plurality of T/R modules in a plurality of rows with the photodetector locations of each row of modules facing in the same direction; a plurality of elongate light distribution elements each having a substantially planar surface disposed opposing the photodetector location of a respective row of modules, each light distribution element including a plurality of optical fiber bundles for each row of modules, each fiber bundle having an output end mounted to the planar surface adjacent a respective photodetector location, each fiber bundle having an entrance end common at least to the plurality of optical fiber bundles corresponding to a light distribution element for a respective row of modules; optical light source means mounted to the housing adjacent to the entrance end of each light distribution element for supplying light signals to the fiber bundles; optical means mounted to each T/R module for directing the light from the output end of the corresponding fiber bundles across an air gap onto photodetectors.

In another aspect, the optical data distribution system of the present invention preferably comprises a plurality of light bars, each including a plurality of ribbon assemblies having a common light entrance aperture.

In another aspect, the optical data distribution system of the present invention preferably comprises a star coupler for coupling the optical source means to corresponding entrance apertures of each respective light bar. In a further aspect, each optical means includes a microprism for providing a bend to the distributed light for entrance to the photodetector. The accompanying drawings, which are incorporated in and constitute a part of this specification, illustrate several embodiments of the invention and together with the description, serve to explain the principles of the invention.

BRIEF DESCRIPTION OF THE DRAWINGS

FIG. 1(*b*) is an enlarged fragmentary sectional view of a wall of the housing of FIG. 1 illustrating recesses for receiving optical distribute elements of the present invention.

FIG. 1(*c*) is a fragmentary sectional view illustrating the system for distributing optical data to a row of T/R modules in accordance with the present invention.

FIG. 1(*d*) is a fragmentary sectional view taken on line d—d of FIG. 1(*c*) with T/R modules back to back and illustrating schematically an air gap bridging between the T/R modules and the light distribution element.

FIG. 2(*b*) is a fragmentary view in perspective a polyfurcated light bar according to a second embodiment of the present invention.

FIG. 3(*b*) is a highly magnified fragmentary sectional view of the light distribution element taken on line b—b of FIG. 3(*a*).

FIG. 4(*b*) is a magnified view of the output port of the star coupler of FIG. 4(*a*).

FIG. 5(*b*) is a sectional view of the air gap bridging optics of FIG. 5(*a*) showing the effect of varying certain parameters.

FIG. 6(*b*) is a highly magnified cross-sectional view of the modification of FIG. 6(*b*) in positional relationship with the air gap bridging optics of FIG. 6(*a*).

DESCRIPTION OF THE PREFERRED EMBODIMENTS

Figure 1B:
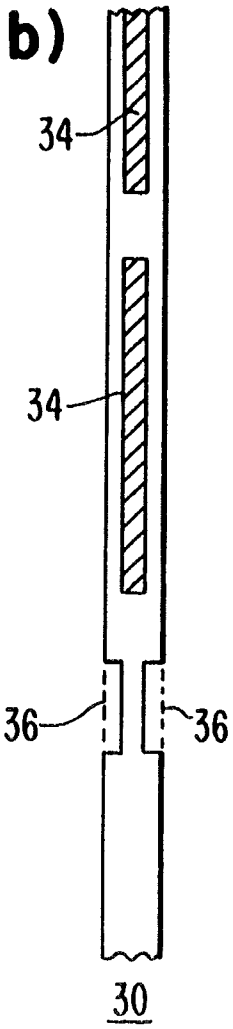
FIG. 1(*a*) is a fragmentary perspective view of a housing for T/R modules of dense packed phased-array antenna illustrating recesses for receiving optical data distribution elements of the present invention.
Figure 1A:
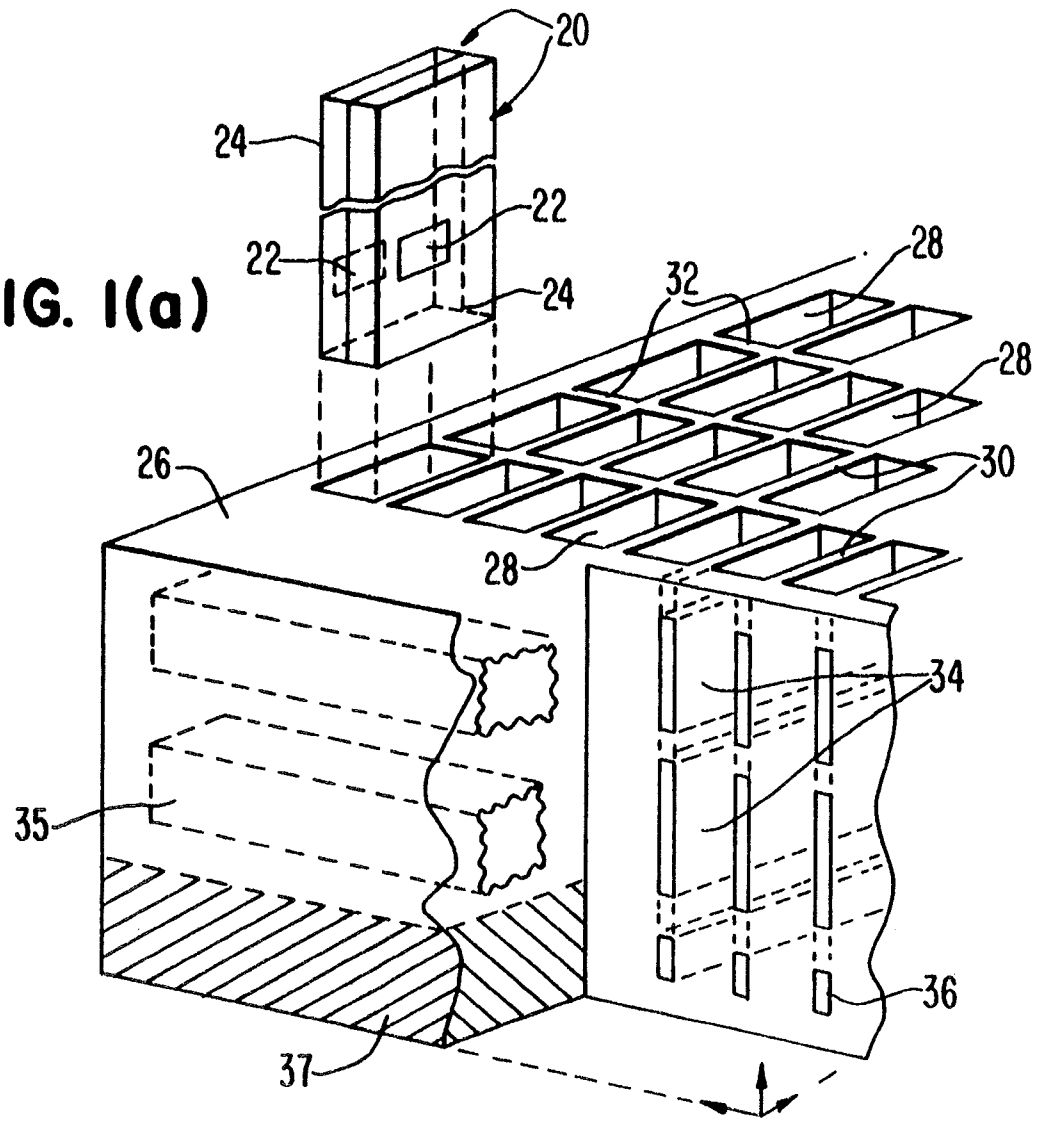
Figure 1C:
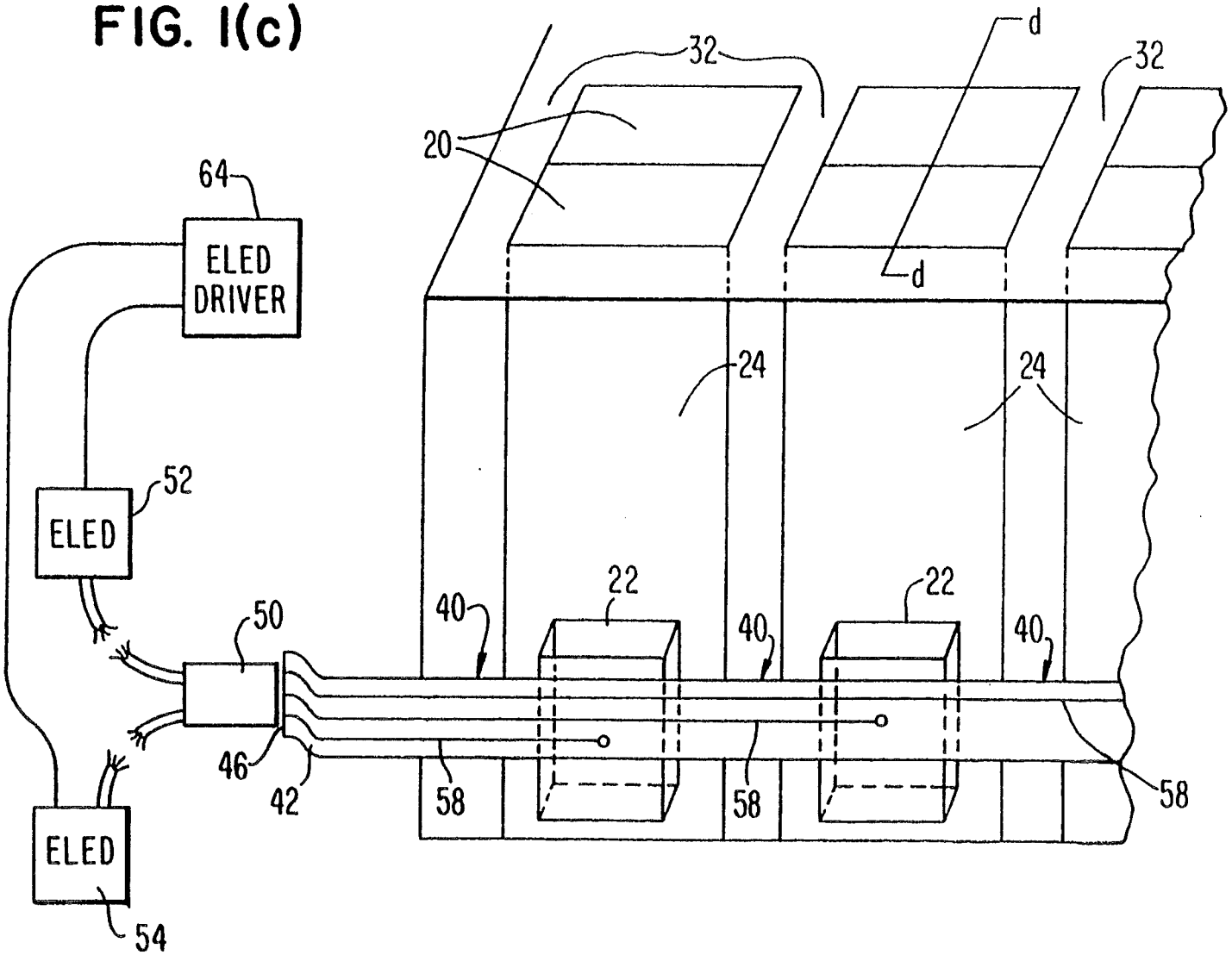
Figure 1D:
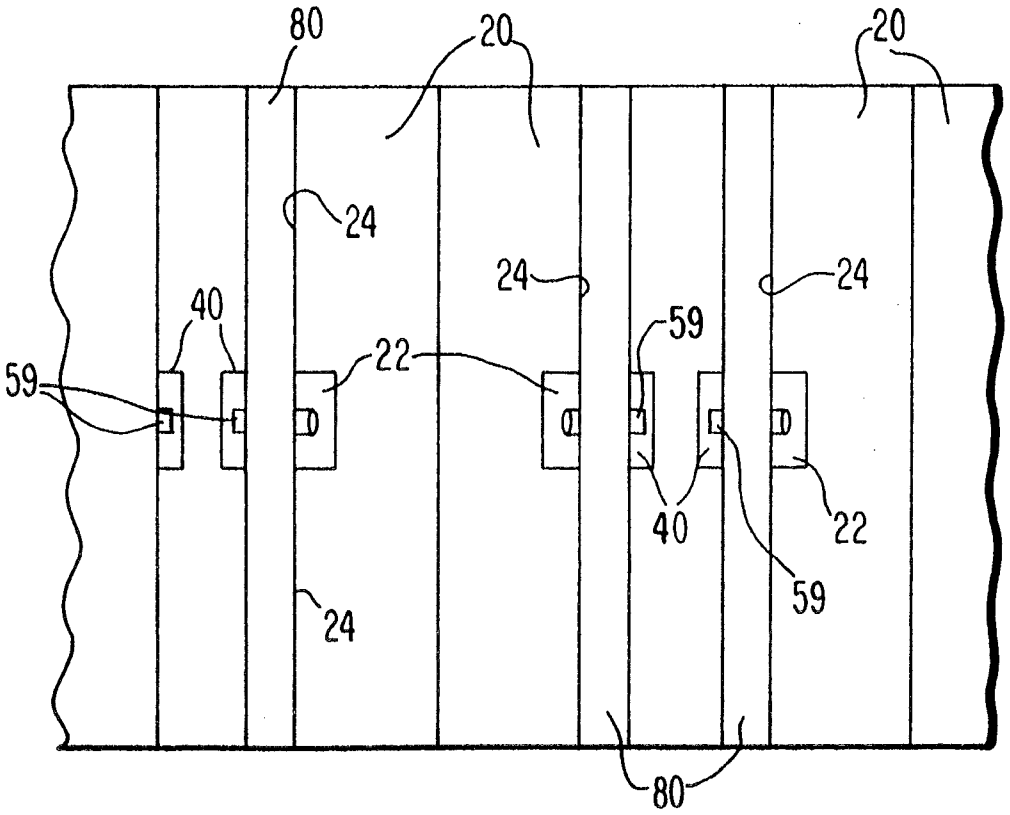

Reference will now be made in detail to the present preferred embodiment of the present invention, examples of which are illustrated in the accompanying drawings. Wherever possible, the same reference numbers will be used throughout the drawings to refer to the same or like parts.

The optical data distribution system of the present invention includes a plurality of T/R modules, each having a photodetector at a predetermined location for receiving optical signals. As herein embodied, and referring to figure 1(*a*), each T/R module 20 is substantially rectangular in configuration and has a photodetector as receiving location 22 disposed at a light receiving area disposed on one planar surface 24 of T/R module 20. Optical means for directing light from an output end of an optical fiber onto the photodetector is mounted to the predetermined location as hereinafter described. Light sources (not shown) may be provided adjacent the optical means in an appropriate portion of the system, such as shown as crosshatched region 37, to supply light to the system.

The system of the present invention includes a housing for supporting the plurality of T/R modules in a plurality of rows with the photodectors location of each row facing in the same direction. Referring again to figure 1(*a*) a housing referred to as 26 may be a unitary structure that includes a plurality of rectangular chambers 28 of uniform size spaced in rows and columns.

Chambers 28 are separated from one another by parallel walls 30, and parallel walls 32 which are arranged perpendicular to walls 30. Each wall 30, 32 preferably has a thickness of, for example, 0.05". A pair of T/R modules 20, each arranged back to back, are inserted into each chamber 28 with the photodetector location facing walls 30.

As shown in FIG. 1(*b*), each wall 30 may include two spaced coolant channels 34. Each coolant channel is preferably disposed opposite heat sinks of T/R modules 20 located on opposite sides of each wall 30 to provide cooling to the T/R modules insert in chambers 28. Each wall 30 also includes in opposite surfaces rectangular recesses 36. Coolant plenums 35 may be provided to supply coolants to coolant channels 34. FIGS. 1(*c*) and (*d*) illustrate a plurality of modules 20 disposed in chambers 28 with photodetector locations 22 facing in the same direction, and preferably aligned with one another.

In accordance with the present invention a plurality of light distribution elements, each having a substantially planar surface are disposed opposing the photodectors locations of a respective row of T/R modules. Each light distribution element includes a plurality of optical fiber bundles for each row of modules, each fiber bundle having an output end mounted to the planar surface adjacent a respective photodetector location and each fiber bundle having an entrance end common at least to the plurality of bundles corresponding to a light distribution element for at least one row of modules.

Figure 2A:
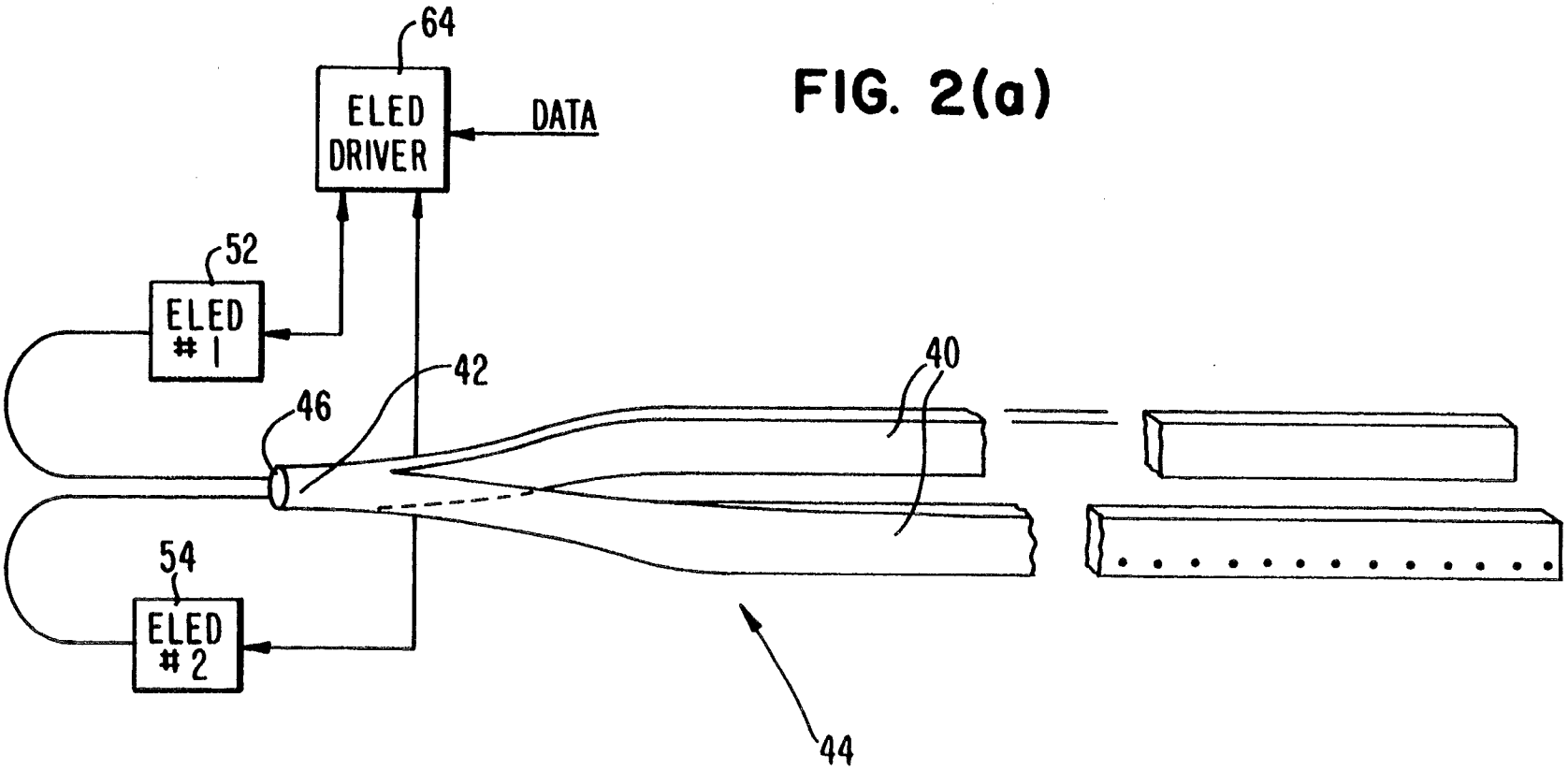
FIG. 2(*a*) is a fragmentary perspective view of a bifurcated light bar of the distribution elements according to a first embodiment of the present invention.
Figure 2B:
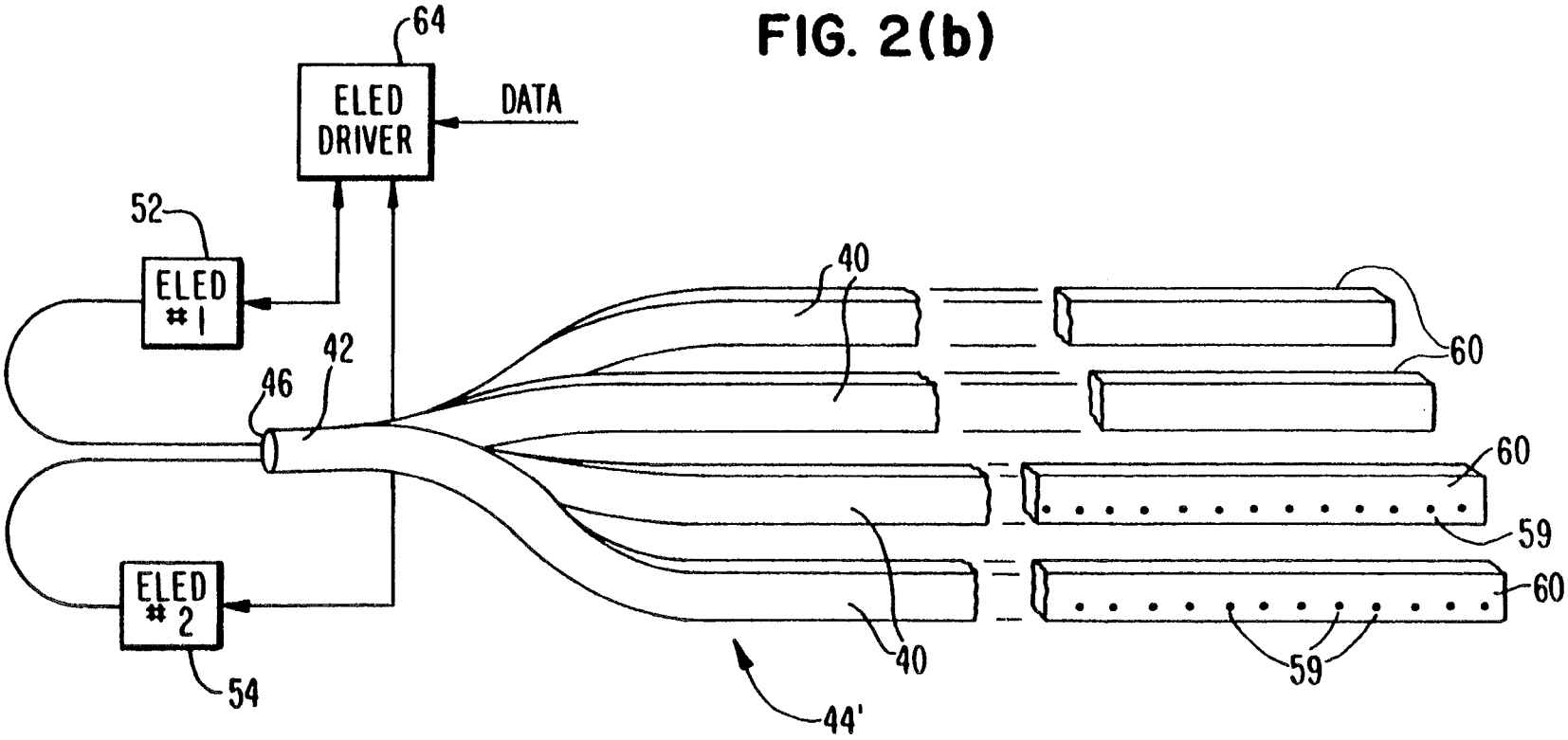

As embodied herein, and referring to FIG. 2(*a*), light distribution elements of the present invention are represented generally by reference numeral 40. Light distribution elements 40 at one end are merged into and taper to a common entrance end 42 of circular cross-section preferably having a diameter of approximately 0.10" (2.5 mm) to form a bifurcated light bar 44. Referring to FIG. 1(*c*), entrance end 42 has a polished face 46. Entrance end 42 may be coupled to a star coupler 50 (see FIG. 1(*c*), which in turn is coupled to the pigtails of edge light emitting diodes (ELEDs) 52, 54 or coupled directly to ELEDs 52, 54 as shown in FIG. 2(*a*). Each bifurcated light bar 44 has a pair of light distribution elements 40, which is (preferably of 0.050" wide and 0.30" high) to fit in a slot formed by surface 24 of modules 20 and recess 36.

Referring to FIG. 2(*b*), a light bar 44' is formed from four individual elongate light distribution elements 40 which are merged into and tapered to a common entrance end 42. Light bar 44', which is polyfurcated, is suitable for portions of the antenna array that have fewer modules aligned in a single row. Referring to FIGS. 2(*a*) and 2(*b*), entrance end 42 of light bar 44, 44' is made of a plurality of fiber-optic bundles that are encapsulated with resins.

Figure 3A:
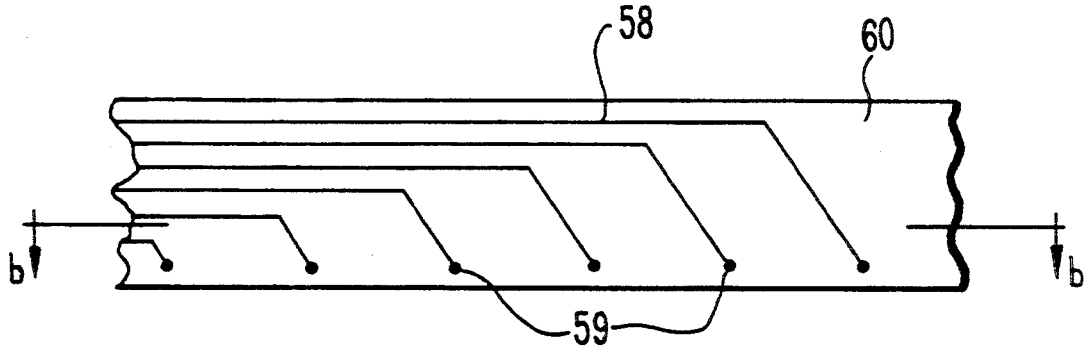
FIG. 3(*a*) is an enlarged fragmentary schematic view of the light distribution element of the light bar of FIGS. 2(*a*) and 2(*b*).
Figure 3B:
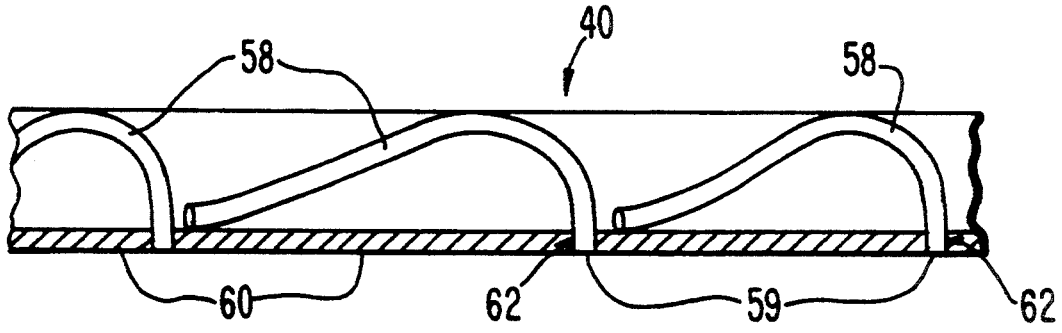

Referring to FIG. 3(*a*), each bifurcated or polyfurcated light distribution element or ribbon assembly 40 is composed of a plurality of fiber bundles 58 that are resiliently encapsulated by elastomeric compounds to provide resilient encapsulation for the delicate fan-out of fiber optic bundles.

Each light distribution element has a cross sectional dimension that corresponds to recess 36 of wall 30. Each fiber bundle 58 of the plurality of fiber bundles is terminated at spaced locations 59 along alignment strip 60 of light distribution element 40 for aligning with photodetectors 22 of each T/R module 20. The number of fiber bundles 58 of each ribbon assembly 40 corresponds to the number of T/R modules in a row. Preferably, the fiber bundle has a core/clad area ratio higher than 100/140, and is flexible with a small diameter (e.g., of about 0.01") and bendable at an angle greater than zero, to permit high packaging efficiency as shown in FIG. 3(*b*).

Referring to FIG. 3(*b*), each fiber bundle 58 in ribbon assembly 40 is terminated at a fiber bundle termination location or point 59 to provide efficient optical coupling to respective T/R module 20. An alignment plate 60 of each light distribution element or ribbon assembly has perforations 62 each for receiving and housing a corresponding fiber bundle output end. Alignment plate 60 may be a piece of plastic. Each fiber bundle output end or termination point 59 is bonded with adhesive into the corresponding perforation 62 and polished flush with the surface of alignment plate 60. Perforations 62 facilitate accurate positioning of output ends 59 of each fiber bundle 58 relative to the respective T/R modules 20.

Each bifurcated light bar 44 of the invention may, for example, provide optical energy to a row of up to 30 T/R modules. For example, in a phased-array containing 2000 modules, this basic distribution element would be repeated as many times as necessary. However, for antenna array extremities where each row may include less than ten (10) T/R modules, the use of a polyfurcated or multibranched light bar 44 having three or more ribbon assemblies would yield higher optical energy economy, than the use of multiple bifurcated light bars.

The optical data distribution system of the present invention comprises an optical light source means mounted to the housing adjacent the entrance end of a plurality of light bars for supplying optical signals to the entrance end of each light bar. As herein embodied, and referring to FIG. 2(*a*) and 2(*b*), light source means preferably comprises a pair of edge-light emitting diodes 52, 54 for supplying light to entrance aperture 46, which are driven by ELED driver 64.

Referring to FIG. 2(*c*), ELEDs 52, 54 are preferably coupled to star coupler 50, which in turn is coupled to entrance end 42 of light bar 44, 44'.

In practice, guided wave technology is generally used to transmit Manchester coded control data typically at a bit rate of 50 Mbit/sec and to detect the same at each T/R module with $<10^{-9}$ BER. For short optical data distribution distances (e.g., 3-10 ft.) of interest, it has been known that optical fibers having a cross-sectional, radial, stepwise index of refraction variation ("step index fibers") provide adequate bandwidth to avoid inter-symbol interference problems and offer high optical energy transfer efficiency (i.e., little or no loss).

Figure 4A:
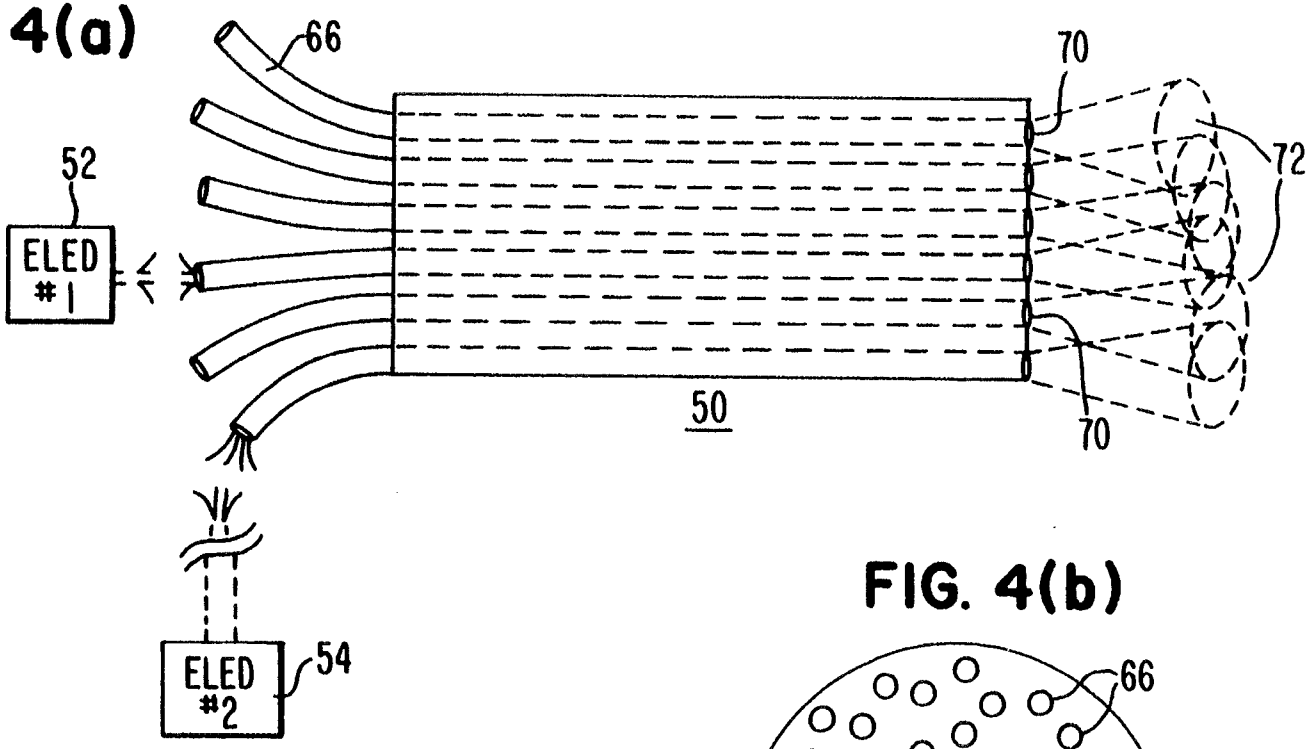
FIG. 4(*a*) is a highly magnified schematic view of a star coupler for coupling a light source to the entrance of the light bars of FIGS. 2(*a*) and 2(*b*).
Figure 4B:
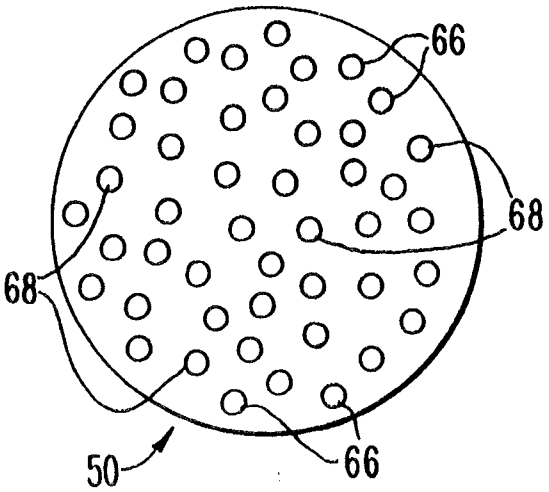

Star coupler 50, as embodied herein, and schematically shown in FIGS. 4(*a*) and 4(*b*) for example, includes thirty-two individual step index fiber 66 (each fiber typically of a conventional 100/140 core/clad area ratio and numerical aperture ("N.A.") of 0.29). Each fiber has an input port 68 adaptable for coupling to ELED #1 or ELED #2 and an output port 70. Preferably, output ports 70 of all fibers 66 of each star coupler 50 of the invention are fused and polished to provide a flat face for efficient optical energy transfer, and are collectively coupled to entrance aperture 42 of an adjacent light bar 44, 44.

The primary function of the star coupler is to uniformly divide the optical energy from sources 52, 54. For example, as shown in FIGS. 4(*a*) and 4(*b*), the optical energy which is presented at input port 66 of any particular one of individual fibers 66 of star coupler 50 is uniformly divided among output ports 70 of all of fibers 66 of star coupler 50 with a minimum of excess loss, thus providing multiple overlapping footprints 72 of uniform intensity to entrance aperture 46 of light bar 44 and high uniformity in coupling of multiple output ports 72 to entrance aperture 46 without excessive energy overspill (i.e., loss).

Preferably, fused output ports 72 of star coupler 50 has a diameter (e.g., of about 0.03" (0.75 mm)) smaller than the diameter (e.g., of about 0.10" (2.5 mm)) of entrance aperture 42 of light bar 44, 44' to ensure desirable uniformity of power division without excessive insertion loss.

Types of optical coupling structures (other than the type shown in FIGS. 4(*a*) and 4(*b*)) that perform the same function would be also acceptable for the present invention, For example, coupler of the invention could have a larger number (e.g., 60) of fibers (e.g., of 100/140 step index) in order to have the same diameter as entrance aperture 44 of light bar 44, 44', with acceptable specifications. Light bar 44, 44' of the invention can be fabricated entirely of 100/140 step index fibers, as a single integrated piece with obvious advantages. Although 100/140 step index fibers would be considerably less flexible than fiber bundles 300 for light bar 200, a 90° bend of the light signals could still be made in limited space utilizing a microprism, which will be described in greater detail in reference to FIGS. 6(*a*) and 6(*b*) hereinafter.

ELEDs 52, 54 have a fiber pigtail as shown at in figure 4(*a*). The fiber pigtails of each of a selected pair of input ports 68 of star coupler 50 can be spliced to the fiber pigtails of a respective one of ELEDs 52, 54, where ELEDs 52, 54 operate at a common wavelength (e.g., 830 nanometers). Input port 68 of another one or more fibers of star coupler 50 can be spliced in a conventional manner to the fiber pigtails of a respective ELED operating at a wavelength different than the common wavelength, should wavelength division be required.

Although ELEDs are highly reliable (e.g., mean time between failures ("MTBFs") of $10^7$ hours at 25° C.), two ELEDs, for example, ELEDs 52, 54, are provided to ensure redundancy and graceful (or nonabrupt) degradation. Additional input ports of star coupler 50 would facilitate additional ELEDs, should further redundancy be required; however, this would make ELED circuitry more complex and/or consume higher power. The use of a small number of high power ELEDs (e.g., two as shown in FIGS. 2(*a*), 2(*b*)) rather than using a large number of low power ELEDs would help reduce overall optical source complexity.

Although light emitting diodes (LEDs) and laser diodes are not totally excluded, ELEDs are preferred over LEDs and laser diodes as optical source for lower cost, less sensitivity to optical reflections, easy stabilization, and higher reliability. Moreover, ELEDs exhibit adequate modulation bandwidth (e.g., rise/fall times of 2.5 nsec.), and produce noncoherent light. Noncoherent light is particularly important for a simple type of signal distribution system as proposed here which usually exhibits "speckle selective" loss when transmitting coherent light, as will now be explained.

For example, speckle selective loss occurs where optical energy coupled to the photodetector of the T/R module overlaps the sensitive area of the photodetector. Speckle selective losses introduce modal noise when multimode optical fibers are mechanically perturbed, for example, by vibration; this degrades system signal to noise ratio.

Fast ELEDs operating at 850 nanometer wavelength can deliver more than 0.5mW of optical energy (−3dBm) to 100/140 step index fibers with a N.A. of 0.3. Losses associated with star coupler 50 feed to light bar 44, 44' (assuming N.A. match) are estimated at −7dB. The 60:1 power split (−18dB) yields typical power of −28dBm at fiber bundle termination 59. Losses in the short runs of fiber is negligible compared to other losses.

A coupling loss of −4dB of fiber bundle termination 59 to photodetector 22 of T/R module 20 is typical, resulting in −32dBm at the photodetector (plus or minus the power split non-uniformity at entrance aperture 42 of light bar 44, 44'). A typical operating point of a PIN-FET photodetector 22 at a bit rate 50 Mbit/sec is −34dBm with useful dynamic range from −24 to −44 dBm; thus an adequate signal level can be provided with commercially available devices, and functional tolerances can be accommodated.

AS stated above, fiber bundles 58 in light bar 44, 44' of the present invention are flexible and have a high core/clad area ratio. Flexible high core/clad area ratio fiber bundles 58 ensure high coupling efficiency to star coupler 50 of an equal N.A. because high packaging efficiency (e.g., 75–80%) is obtained; for example, flexible fiber bundles having a core/clad area ratio of 49:1, diameter of 50–200 um, N.A. of 0.24–0.66, and epoxy packing efficiency of 75–80% are commercially available.

Packaging efficiency is also important at fiber bundle output termination 59 to minimize its diameter; this enhances coupling efficiency of the optics for bridging an inherent air gap between fiber bundle termination 59 of light distribution element 40 and photodetector 22 of T/R module 20 by permitting a smaller image size projected by fiber bundle 58 at the photodetector under finite conjugate conditions, and reducing divergence under collimated conditions.

Referring to figure 1(*d*), air gaps such as 80 between fiber bundle output termination 59 and photodetector 22 is inherent because the photodetector of the T/R module can not be brought into physical contact with the fiber bundle output termination 59 for mechanical reasons (e.g., the wall thickness of the T/R module 20 prevents the photodetector from being in direct contact with the fiber bundle termination).

In accordance with the present invention, the optical data distribution system includes optical means mounted to each of the T/R modules for directing the light from the output end of a respective fiber bundle to a corresponding photodetector location. As embodied herein, the optical means of the invention includes air gap bridging optics as shown in FIGS. 5(*a*), 5(*b*), 6(*a*) and 6(*b*).

Figure 5A:
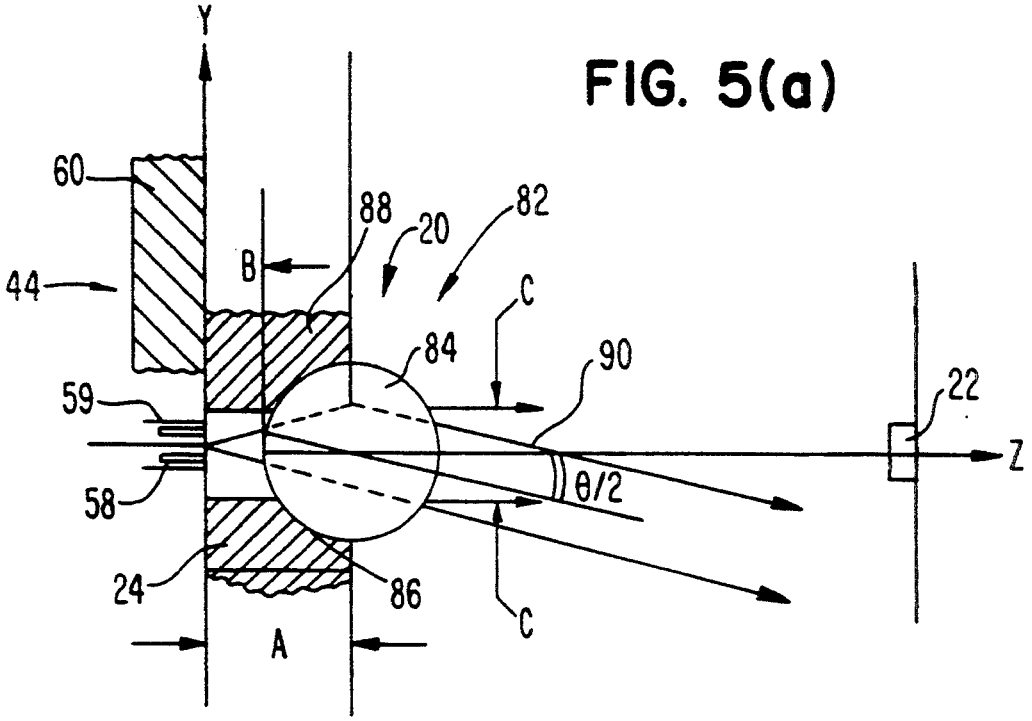
FIG. 5(*a*) is a highly magnified cross-sectional view of an air gap bridging optics of the optical data distribution system according to an embodiment of the present invention.
Figure 5B:
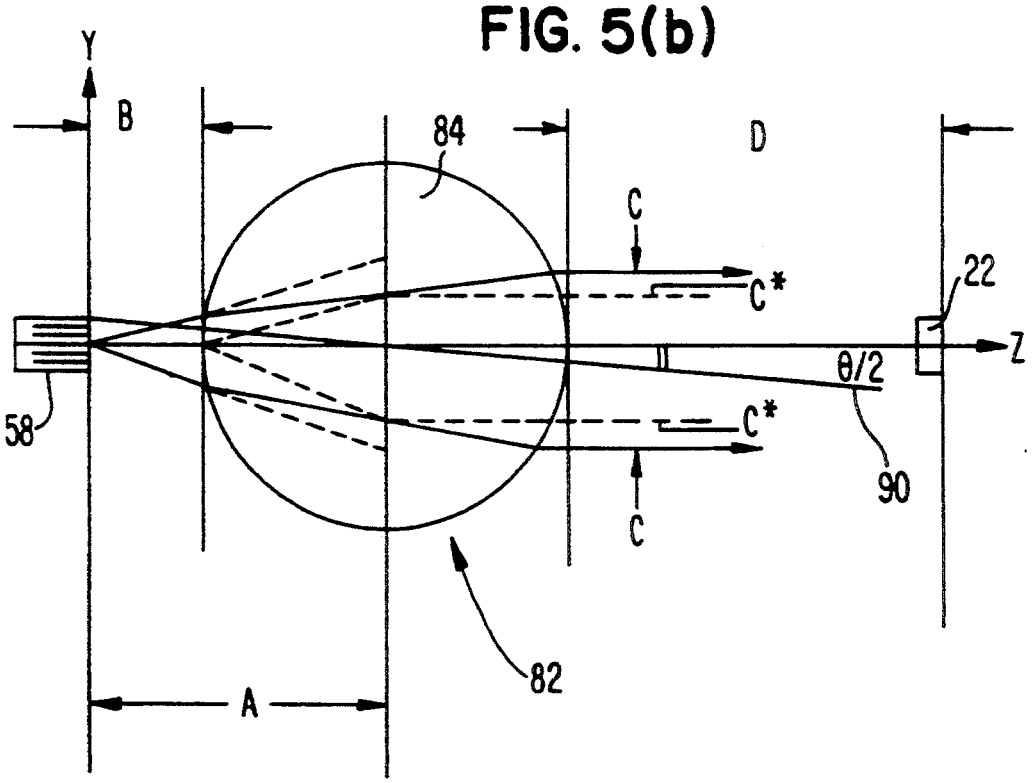

For example, referring to FIGS. 5(*a*) and 5(*b*), each air gap bridging optics 82 employs a spherical lens or sphere 84 of appropriate materials. Sphere 84 as a collimating lens may be a fused silica sphere having a diameter of about 0.04"(1 mm) and a refractive index $N_{830}$ of 1.45. Preferably, sphere 84 is hermetically sealed into a hemispherical declivity 86 directly in a wall 88 of a respective T/R module 20 having a thickness A (e.g., of 0.32").

Small size spheres or spherical lenses are robust and inexpensive, and their mounting orientation is not critical. For example, sphere 84 of a 1 mm (about 0.04") diameter enables a short working distance (e.g., of about 0.04"(0.3 mm) between fiber bundle termination 59 and photodetector location 22 of T/R module 20 and reduces the criticality of positioning of photodetector along the Z axis.

Spheres are preferred for optical coupling for ease of fabrication. However, miniature versions of conventional simple and compound lenses where higher cost is justified, may be used. For example, a simple aspheric or a two element achromat might be justified in cases where spherical aberration must be minimized. However, in most cases, the effect of spherical aberration is negligible compared to the effect of other unavoidable limitations of the bridging optics.

The radius and refractive index of the sphere is selected to effectively couple optical energy to the photodetector. As embodied herein, and as will be explained in reference to FIGS. 5(*a*) and 5(*b*), the radius (or diameter) and refractive index ($n_{830}$) of sphere 84 (e.g., of about 0.04"(1 mm diameter) shown in FIG. 5(*a*) is selected to optimize design factors such as a working distance B (e.g., about 0.01"(0.3 mm)), exit beam diameter C (e.g., about 0.02"(0.5 mm)), and exit beam divergence angle $\theta$ (e.g., semi-divergence angle $\theta/2 \leqq 8.9$). This is a real advantage when the designer is faced with a number of other constraints such as specific air gap distances 80 to bridge, certain positional tolerances, T/R module wall thickness, maximum permitted sphere diameter etc. The optimization is based upon a thick lens expression for focal length F of a sphere measured from the center thereof where radius is R and refractive index is n:

$$F = \frac{nR}{2(n-1)}$$

In FIGS. 5(*a*) and 5(*b*), a collimated beam 90 leaving sphere 84 is divergent due to the finite dimension (e.g., 0.004"(0.1 mm) diameter) of fiber bundle 58. The area of footprints of the diverging collimated beam 90 projected onto photodetector 22 depends upon the position of photodetector 22 along a Z axis. In FIG. 5(*a*), photodetector 22 which has a light detecting area with a diameter of about 0.02" (0.5 mm) and is coaxial to the Z axis would incur a 4dB area mismatch loss of optical energy due to footprint spill-over (or overfill).

Although the overfill introduces insertion loss, it has the benefit that the coupling is less sensitive to positional errors. In the case shown in FIG. 5(*a*), a fiber bundle axis Y can be displaced ±0.005" with respect to the Z axis before additional losses incur, assuming photodetector 22 has the same diameter of the light detecting area as above, large enough diameter for efficient light collection yet small enough for low shunt capacitance. In practice, a photoreceiver chip of T/R module 20 has a reverse biased PIN photodiode driving a FET or transimpedance amplifier; the bandwidth of this PIN photodetector—FET or transimpedance amplifier combination is strongly dependent on and inversely proportional to the shunt capacitance of the photodetector.

FIG. 5(*b*) shows the effect of change of the radius and/or the refractive index of sphere 84 on working distance B, exit beam diameter C, exit beam divergence angle $\theta$, and positional error in reference to FIG. 5(*a*). In figure 5(*b*), sphere 84 of the same material (preferably, $n_{830}=1.45$ of a fused silica) as the sphere of FIG. 5(*a*) has a diameter (e.g., about 0.08" (2 mm)) twice as large. This approximately doubles working distance B (e.g., about 0.02" (0.6 mm)) and collimated beam diameter C (e.g., about 0.01" (1 mm)) and halves exit beam divergence $\theta$ (e.g., semi-divergence angle $\theta/2 \leqq 4.5$). The increased working distance, which may be a mechanical necessity, reduces optical energy coupling to photodetector 22 having a small diameter (e.g., about 0.02" (0.55 mm)) due to large exit beam diameter C. However, the reduced exit beam divergence prevents further reduction in optical energy coupling which would result from an increase, should it be required, in a mechanical separation D between sphere 84 and photodetector 22.

If the refractive index of sphere 84 is increased (e.g., to $n_{830}=1.83$ from $n_{830}=1.45$), working distance B is significantly reduced (e.g., to about 0.004" (0.1 mm) for $n_{830}=1.83$) and collimated exit beam diameter C is reduced to C* shown in FIG. 5(*b*); the reduced exit beam diameter C* improves optical energy coupling to photodetector 22 having a small diameter (e.g., about 0.02" (0.5 mm)). However, there is some increase in exit beam divergence $\theta$, resulting in an increase in the sensitivity to positional error. Therefore, trade-offs between exit beam diameter C and exit beam divergence $\theta$ should be made for optimization when the radius and the refractive index of the sphere are varied.

Figure 6A:
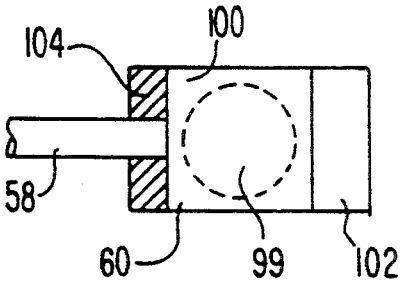
FIG. 6(*a*) is a fragmentary plan view of a modification of the light distribution element of the light bar of the present invention.
Figure 6B:
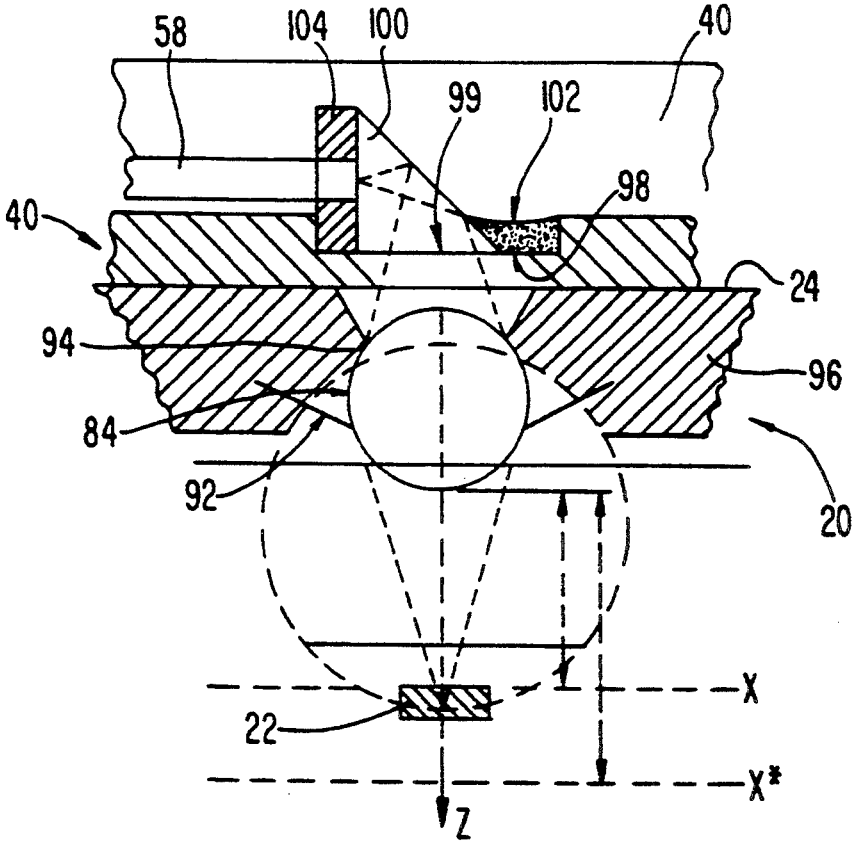

A specially designed wall insert as shown in FIG. 6(*b*) may be used which simplifies assembly. Collar spring 92 holds sphere 84 against a surface 94 of a wall 96 of module 20. This insert acts as a convenient subassembly for sphere retention, the sphere can be hermetic with a suitable sealant. Alignment plate 60' may include a plurality of spaced recesses 98 surrounding opening 99 for alignment with a respective photodetector 22 of each module for supporting a prism 100. Prism 100 provides a bend of light at an angle greater than zero in the fiber bundle such as 58. As embodied herein, the microprism means of the invention, which is generally represented as a microprism 100 in FIGS. 6(*a*) and 6(*b*), is provided in the surface of alignment plate 60 facilitate a 90° bend in the optical path between fiber bundle termination 59 and photodetector 22 of the T/R module to substantially reduce, if not completely eliminate, the need for bending of the fiber bundle in a confined space.

As previously mentioned, the less flexible step index fiber optics may be used and/or it may not be desirable to bend the fibers as shown in FIG. 3(*b*). Recess 98 prevents microprism 100 from rotating around the axis normal to the longitudinal axis of alignment plate 60. As heretofore mentioned, the recess means of the invention is generally represented 98, which is provided in the surface of alignment plate 60 to retain and accurately position microprism 100 relative to a coupling port 99 of T/R module 20, and to prevent microprism 100 from rotating around the Z-axis. For example, microprism 100 is placed in locating recess 98 and potted by material 102. Microprism 100 is preferably embedded together with fiber bundle termination 59 within alignment plate 60 with elastomeric encapsulation to provide resiliency and thus reliability. The encapsulation protects these delicate optical components from the environment and constrains them to provide support under vibrational stress.

To facilitate assembly and minimize positional errors, the microprism means of the invention preferably includes a centering guide piece 104 for accurately positioning the output end the fiber bundle to microprism 100. As embodied herein, the centering guide of the invention is permanently bonded to an entrance face of microprism 100 to accurately locate fiber bundle output end 59 at the center of the entrance face. For example, fiber bundle termination 59 is inserted into and then bonded to centering guide 104 with optical cement having an optical index matching that of microprism 100.

Similar to FIGS. 5(*a*) and 5(*b*), optical means of the invention includes sphere 84: a solid line in FIG. 6(*b*) generally represents a small sphere having a diameter of about 0.04" (1 mm) and a refractive index of $n_{830}=1.45$, and a dashed line generally represents a large sphere of about 0.08" (2 mm) diameter and $n_{830}=1.83$. Preferably, sphere 84 is inserted into recess 98 of a wall of T/R module 20, and is retained under stress against wall surface 94 with collar spring 92. Contact areas 94 between sphere 84 and recess 98 are hermetically sealed (e.g., with wick-in Locite TM).

Photodetector 22 of T/R module 20 is laterally aligned with a focal plane X in FIG. 6(*b*) for the small sphere of about 0.04" (1 mm) diameter and a focal plane X* for the large sphere of about 0.08" (2 mm) diameter. Focal plane X is distanced from the nearest surface of the respective sphere at about 0.044" and focal plane X* at 0.1". Therefore, the focal plane changes with the sphere diameter.

To increase optical coupling efficiency to photodetector 22 having a light detecting area of a small diameter, one to one imaging is used to bridge the large air gap between fiber bundle termination 59 and photodetector 22 of T/R module 20 that is necessitated by the provision of microprism 100. Alternative image transfer ratio (other than the one to one imaging) are also possible while maintaining a large working distance between fiber bundle termination 59 and sphere 84.

The one to one imaging is achieved when object and image planes are located at twice the focal length of the spherical lens measured from the lens' center. Ideally the image size of fiber bundle termination 59 projected at photodetector 22 would be about 0.01" in diameter, providing high coupling efficiency to photodetector 22 having a light detecting area of a small (e.g., 0.02" (0.5 mm)) diameter. In practice, the increased working distance between the fiber bundle termination and the air gap bridging optics will cause the N.A. of the fiber bundle termination to illuminate more than the lens aperture; this will worsen spherical aberration introduced by the lens, and increase the image size although the photodetector may still capture the image.

Several approaches to reduce spherical aberration are available; the most obvious being the use of fibers with reduced N.A. However, where the reduced N.A. of the fibers is not practical for other considerations, the radius and refractive index of the sphere or spherical lens are controlled to reduce spherical aberration, as discussed above; for example, a larger radius combined with a high refractive index reduces spherical aberration.

Use of the alternative image transfer ratio allows conjugate ratios which would produce a demagnified image of the fiber bundle termination projected at the photodetector; thus facilitating efficient optical energy coupling to the photodetector having a small diameter of light detecting areas (i.e., important for higher bandwidth applications), closer positioning of the photodetector to the spherical lens (i.e., important if space is limited), and reducing the sensitivity to positional errors in the same ratio as the demagnification factor.

Since the image size of the alternate image transfer at the photodetector can be larger than the theoretical value due to spherical aberration, and the same approaches discussed above in reference to the one to one image transfer may be applied to this alternate image transfer to compensate for spherical aberration. In extremely critical applications, however, the ultimate solution would be to substitute aberration-free optics for the sphere if higher cost were Justified.

For example, a larger diameter sphere (e.g., of a 0.08" (2 mm) diameter) of FIG. 6(*b*) could be used in conjunction with the one to one imaging, provided that mechanical constraints are met. The use of other conjugate ratios to produce demagnified images is a logical extension. Again there are trade-offs involved, both mechanical and optical—the latter including the magnitude of spherical aberration that can be tolerated. Each situation must be analyzed to arrive at an optimum approach.

Other modifications of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

For example, it is shown that the invention could be applied to a unitary structure phased-array antenna that imposes significant physical constraints. Although this disclosure addresses difficulties exemplified in certain configurations of the phased antenna array, the difficulties are not limited to these configurations alone.

What is claimed:

1. An optical data distribution system for a phased array antenna, comprising:

a plurality of T/R modules, each having a photodetector at a predetermined location for receiving optical control signals;

a housing supporting the plurality of T/R modules in a plurality of rows with the photodetector location of each row facing in the same direction;

a plurality of elongate light distributing elements mounted to the housing having a substantially planar surface portion disposed opposing the photodetector locations of a respective row of T/R modules, each of said plurality of light distributing elements including a plurality of optical fiber bundles for each row of modules, each fiber bundle having an output end mounted to said planar surface adjacent a respective photodetector location of a corresponding T/R module and an entrance end terminating in a bundle of fibers common to at least one row;

optical light source means mounted to the entrance end of each of the light distributing elements for supplying optical signals to each of the plurality of fiber bundles; and optical means mounted to each of the T/R modules for directing light from the output end of each fiber bundle to the photodetector of each T/R module.

2. The system of claim 1 wherein the housing includes a plurality of parallel walls defining a plurality of chambers containing the plurality of T/R modules, and each of the parallel walls includes a recess therein extending between orthogonal walls, and one of the light distributing elements is mounted in each of the recesses.

3. The system of claim 1 wherein the plurality of light distributing elements are joined at a common entrance end to constitute a light bar.

4. The system of claim 3 wherein the planar surface of each light distributing element is an alignment plate having perforations therein for supporting a fiber bundle output end at a bend angle of approximately 90° to the entrance end.

5. The system of claim 3 wherein each light bar is a plurality of fiber bundles encapsulated by a resilient elastomeric compound.

6. The system of claim 3 wherein each light bar includes at least three light distributing elements.

7. The system of claim 3 wherein the optical light source means includes a plurality of light emitting diodes and a star coupler having an input end coupled to at least a pair of the light emitting diodes and on output end in communication with the common bundle of fibers at the entrance end of the light bar.

8. The system of claim 7 wherein each of said at least a pair of the light emitting diodes operates at a common wavelength.

9. The system of claim 7 wherein at least one of said at least a pair of the light emitting diodes operates at a wavelength different from the operating wavelength of the other.

10. The system of claim 7 wherein the star coupler has optical fibers with a 100/140 step index.

11. The system of claim 10 wherein each of the fiber bundles of the elongate light distributing element has a step index of 100/140.

12. The system of claim 1 wherein the optical means includes an opening in the wall of the T/R module in alignment with the photodetector, and a spherical lens mounted covering the opening having a selected radius and refractive index for directing light from the output end of each fiber bundle to the photodetector.

13. The system of claim 12 wherein the spherical lens is a fused silica sphere.

14. The system of claim 12 wherein the output end of each fiber bundle extends substantially longitudinally of the planar surface, and the light distributing element further comprises a microprism means attached to the output end of each fiber bundle for bending the light approximately 90° toward the photodetector.

15. The system of claim 14 wherein the microprism means includes a centering guide member supporting the output end of each fiber bundle, a microprism attached to the centering guide, and an elastomeric compound fixing the centering guide and microprism to the planar surface.

16. The system of claim 3 wherein the light bar includes at least two light distributing elements having a common entrance end.

17. The system of claim 3 wherein the light bar includes at least three elongate light distributing elements having a common entrance end.

18. An optical system comprising:

fiber optic carrier means having an output end;

a light detecting module for receiving light from said fiber optic carrier means, said module having a photodetector and a wall with an opening adjacent the output end of said fiber optic carrier means in alignment with said photodetector; and a spherical lens mounted covering said opening and having a selected radius and refractive index for directing the light from the output end of said fiber optic carrier means to said photodetector;

wherein said fiber optic carrier means extends substantially longitudinally of a planar surface of said wall, and said optical system further comprises microprism means adjacent the output end of said fiber optic carrier means for bending the light approximately 90° toward the photodetector.

19. The system of claim 18 wherein the microprism means includes a centering guide member supporting the output end of the fiber optic carrier means, and a microprism attached to the centering guide.

20. The system of claim 18 wherein the microprism means further includes an elastomeric compound for attaching the microprism to the centering guide.

* * * * *